US005948583A

United States Patent [19]

Silence et al.

[11] Patent Number: 5,948,583

[45] Date of Patent: Sep. 7, 1999

[54] TONER COMPOSITION AND PROCESSES THEREOF

[76] Inventors: Scott M. Silence, 42 Nelson St., Fairport, N.Y. 14450; Samir Kumar, 62 Pennicott Cir., Penfield, N.Y. 14526; Carol A. Fox, 19 Leeward La., Canandaigua, N.Y. 14424

[21] Appl. No.: 09/058,997

[22] Filed: Apr. 13, 1998

[51] Int. Cl.[6] ..... G03G 9/097

[52] U.S. Cl. ..... 430/110; 430/97

[58] Field of Search ..... 430/110, 97

[56] References Cited

U.S. PATENT DOCUMENTS

| | | | |
|---|---|---|---|
| 2,871,233 | 1/1959 | Pfitzer et al. | 260/151 |
| 2,891,939 | 6/1959 | Schetty | 260/145 |
| 2,933,489 | 4/1960 | Biedermann | 260/145 |
| 2,986,521 | 5/1961 | Wielicki | 252/62.1 |
| 3,590,000 | 6/1971 | Palermiti et al. | 252/62.1 |
| 3,893,935 | 7/1975 | Jadwin et al. | 252/62.1 |
| 3,900,588 | 8/1975 | Fisher | 427/19 |
| 3,944,493 | 3/1976 | Jadwin et al. | 252/62.1 |
| 4,007,293 | 2/1977 | Mincer et al. | 427/19 |
| 4,053,462 | 10/1977 | Beffa et al. | 260/145 |
| 4,079,014 | 3/1978 | Burness et al. | 252/62.1 |
| 4,206,064 | 6/1980 | Kiuchi et al. | 430/106 |
| 4,298,672 | 11/1981 | Lu | 430/108 |
| 4,314,937 | 2/1982 | Beffa | 260/145 |
| 4,338,390 | 7/1982 | Lu | 430/106 |
| 4,394,430 | 7/1983 | Jadwin et al. | 430/110 |
| 4,404,271 | 9/1983 | Kawagishi et al. | 430/110 |
| 4,411,974 | 10/1983 | Lu et al. | 430/106 |
| 4,433,040 | 2/1984 | Niimura et al. | 430/109 |
| 4,560,635 | 12/1985 | Hoffend et al. | 430/106.6 |
| 4,774,395 | 9/1988 | Yabuuchi et al. | 219/275 |
| 4,795,689 | 1/1989 | Matsubara et al. | 430/99 |
| 4,917,982 | 4/1990 | Tomono et al. | 430/99 |
| 4,921,771 | 5/1990 | Tomono et al. | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,124,225 | 6/1992 | Shibata | 430/110 |
| 5,376,494 | 12/1994 | Mahabadi et al. | 430/137 |
| 5,424,112 | 6/1995 | Kataoka et al. | 428/156 |
| 5,824,446 | 10/1998 | Nishihara et al. | 430/110 |

OTHER PUBLICATIONS

Grant, Roger and Claire Grant. Grant & Hackh's Chemical Dictionary. New York: McGraw–Hill, Inc. p. 116, 1987.

*Primary Examiner*—Christopher D. Rodee
*Attorney, Agent, or Firm*—John L. Haack

[57] ABSTRACT

A toner including a mixture of first toner with high molecular weight wax, and second toner with a low molecular weight wax.

15 Claims, No Drawings

TONER COMPOSITION AND PROCESSES THEREOF

REFERENCE TO COPENDING APPLICATIONS AND ISSUED PATENTS

Attention is directed to commonly owned and assigned copending application U.S. Ser. No. 09/058,997, filed Feb. 5, 1998, entitled "TONER COMPOSITIONS", which application discloses a toner comprised of a mixture of first toner with wax, and second toner free of wax, and wherein the first and the second toner contain resin, and the first toner with wax contains colorant.

The disclosures of the above mentioned copending application is incorporated herein by reference in its entirety. The appropriate components and processes of this application may be selected for the toners and processes of the present invention in embodiments thereof.

BACKGROUND OF THE INVENTION

The present invention is generally directed to toner and developer compositions, and more specifically, the present invention is directed to negatively, or positively charged toner compositions, and toner particles containing wax additives. More specifically the present invention relates to toners and processes thereof, and which toners are generated from a mixture containing a first toner with high molecular weight wax, and second toner with a low molecular weight wax, and which toners possess a number of advantages, such as minimization, or elimination of toner flow reduction, or fall off, improved toner transfer, acceptable developed toner mass, reduction in the amount of wax that escapes from the toner, and providing images with excellent resolution, and reduced background deposits after extended imaging cycles, for example, after about 500,000 imaging cycles. The aforementioned toner compositions can contain colorants of for example, pigment particles comprised of, for example, carbon black, magnetites, or mixtures thereof, cyan, magenta, yellow, blue, green, red, or brown components, or mixtures thereof, and preferably carbon black, thereby providing for the development and generation of black and/or colored images, and in embodiments single component development wherein a carrier or carrier particles are avoided. The toner and developer compositions of the present invention can be selected for electrophotographic, especially xerographic, imaging and printing processes, including color processes.

PRIOR ART

Toner compositions with waxes, such as low molecular weight waxes are known, and such toners are illustrated in for example, U.S. Pat. Nos. 5,023,158, 5,004,666, 4,997,739, 4,988,598, 4,921,771, 4,917,982, and 4,795,689, the disclosures of each patent being totally incorporated herein by reference. Also, toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are generally present in an amount of from about 1 percent by weight to about 10 percent by weight, and preferably in an amount of from about 1 percent by weight to about 6 percent by weight. Several of the aforementioned additives are illustrated in U.S. Pat. Nos. 3,590,000 and 3,900,588, the disclosures of which are totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal (ME) complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Toners with reactive extruded polyesters are illustrated for example, in U.S. Pat. No. 5,376,494, the disclosure of which is totally incorporated herein by reference. The resins, especially the polyester resins of this patent are suitable as toner resin for the present invention.

The aforementioned patents are incorporated in their entirety by reference herein.

There remains a need for an economical, efficient, and environmentally acceptable method for the preparation of toners with, for example, superior flow, environmental stability, and charging properties, and imaging processes thereof.

SUMMARY OF THE INVENTION

Embodiments of the present invention, include providing:

A toner comprised of a mixture of first toner with high molecular weight wax, and second toner with a low molecular weight wax;

Preparing a toner from a mixture of first toner with high molecular weight wax, and second toner with a low molecular weight wax, and wherein the first toner and the second toner contain a resin and colorant; and An imaging process comprising:

contacting a toner comprised of a mixture of first toner with high molecular weight wax, and second toner with a low molecular weight wax with a charged image receiving member, wherein a printed image results with high image quality and fidelity.

DETAILED DESCRIPTION OF THE INVENTION

Aspects of the present invention include: a toner generated from a mixture of first toner with high molecular weight wax, and second toner with a low molecular weight wax, and wherein the first toner and the second toner contain resin, and colorant.

The wax content of the resulting toner is from about 2 to about 10 weight percent, preferably from about 3 to about 8 weight percent, and more preferably from about 4 to about 6 weight percent.

In embodiments, the toners of the present invention can further comprise a compatibilizer compound present in amounts of from about 0.5 to about 10 weight percent with respect to the total weight of the toner composition. Compatibilizer compounds include, for example, known block and multiblock polymeric compounds which diminish phase boundaries and phase separation between dissimilar polymeric materials, reference for example U.S. Pat. Nos. 5,569,572, 5,486,445, 5,516,612, and 5,364,724, the disclosures of which are incorporated by reference herein in their entirety.

The high molecular weight wax can have, for example, a weight average molecular weight of about 10,000 to about 20,000, and preferably from about 12,000 to about 17,000, for example, 330P a polypropylene wax with a weight average molecular weight of about 15,000. The low molecular weight wax can have a weight average molecular weight of about 1,000 to about 4,000, and preferably from about 1,500 to about 3,500, for example, 660P a polypropylene wax with a weight average molecular weight of about 2,500. The molecular weight difference between the high molecular weight wax and the low molecular weight wax can be from about 6,000 to about 19,000, and preferably from about to 10,000 to about 15,000. The high and low molecular weight waxes, in embodiments, can be chemically the same, that is, for example, homologous chemical structures differing only in the molecular weight range and crystallinity characteristics of the respective waxes. In other embodiments, the waxes can be chemically different, that is, structurally different, for example, a polyalkylene wax and a hydroxy polyalkylene wax.

Examples of suitable waxes include, for example, polyalkylene waxes prepared from unsaturated monomers having from 2 to about 12 carbon atoms, for example, polyethylene and polypropylene waxes, paraffin waxes, carnuba waxes, hydroxy polyalkylene waxes, functionalized polyolefins such as oxidized polyolefins with acidic or other functional groups, and the like waxes, and other suitable known waxes.

The waxes are selected primarily to achieve the desired fusing and development properties. For example, the desired fusing properties can be expressed as a temperature range between either the lowest temperature at which the toner is fixed to the paper in the fusing subsystem, referred to as the minimum fix temperature(MFT) of the toner, or the lowest temperature at which no effect is detectable on the fused image from the stripper fingers which fingers serve to detach the paper from the fuser role, referred to as the stripper finger mark temperature and the highest temperature above which the toner is offset to the fuser role, referred to as the hot offset temperature(HOT). Ideally this temperature range is greater than about 30° C., with a minimum practical value of about 20 to about 25° C. The desired development properties can be expressed as a difference in the developed mass per unit area for a solid area on a photoreceptor over the life of a developer subsystem. The developed mass on a photoreceptor for a solid area can range from about 0.5 to about 1.5 mg per square centimeter, and a maximum variation in this developed mass is about 0.1 milligrams per square centimeter.

The waxes are chosen so as to achieve the desired fusing and development properties in conjunction with conventional small size and inexpensive additives and or reducing the amount of large size additives in the toner. An exemplary small additive package is, for example: 0.6 percent by weight of a hexamethyldisilazane surface-treated silica with an 8 nanometer particle size, such as TS-530 available from Cabosil Corp.; 0.8 percent by weight of a decylsilane surface-treated titania with a 16 nanometer particle size, such as MT-3103 available from Tayca Corp.; 1.0 percent by weight of untreated titania with a 25 nanometer particle size, such as P-25 available from Degussa Chemicals; and 0.2 percent by weight of the film forming additive zinc stearate available from Synpro Inc. An exemplary large additive package is, for example: 2.8 percent by weight of a γ-aminopropyltriethoxysilane and hexamethyldisilazane surface-treated silica with an 40 nanometer particle size, such as NA50HS available from Nippon Aerosil Corp.; 2.0 percent by weight of a decyltrimethoxysilane surface-treated titania with a 40 nanometer particle size, such as SMT-5103 available from Tayca Corp.; and 0.2 percent by weight of the film forming additive zinc stearate available from Synpro Inc.

Although not wanting to be limited by theory, the toners of the present invention can be viewed as incorporating a single wax component into the toner bulk and wherein the wax has a bimodal molecular weight distribution with the exception that each of the two unimodal molecular weight ranges are segregated into separate toner particles; that is, all of the higher molecular weight wax exists in toner particles which contain substantially no low molecular weight wax and all of the lower molecular weight wax exists in toner particles which contain substantially no high molecular weight wax. Further, the chemical identities of the two waxes can be distinct, that is, the high molecular weight wax can be, for instance consist of polyethylene and the low molecular weight wax can consist of polypropylene which further distinguishes compositions of the present invention from a single bimodal molecular weight distribution wax which is distributed substantially uniformly among all of the toner particles. Segregating waxes with separate molecular weight ranges into separate toner particles assures high crystallinity of the wax, that is, a degradation of the wax crystallinity from that of a unimodal molecular weight wax of about 60% crystallinity to a lower value of 30% crystallinity is avoided, with the corresponding degradation of fusing properties.

The first toner can be selected in amounts from about 10 to about 90 weight percent, and the second toner can be selected in amounts from about 10 to about 90 weight percent based on the total or combined weight of the respective toners, preferably the first toner can be selected in amounts from about 40 to about 60 weight, and the second toner can be selected in amounts from about 40 to about 60 weight percent based on the total or combined weight of the respective toners, and more preferably the first toner is in an amount of about 50 weight percent, and the second toner is in an amount of 50 weight percent based on the total or combined weight of the respective toners.

The colorant can be a dye, a pigment, mixtures thereof, a mixture of pigments, a mixture of dyes, and the like, and can be present in amounts from about 2 to about 10, and preferably from about 2.5 to about 7.5 weight percent based on the total weight of the toner. The colorant can be a carbon black, a magnetite, a cyan pigment, a magenta pigment, a yellow pigment, a red pigment, a green pigment, a blue pigment, a brown pigment, and the like pigments, and mixtures thereof.

The toners of the present invention can optionally contain a charge additive present in an amount of, for example, from about 0.05 to about 5 weight percent, and preferably in an amount of from about 0.1 to about 3 weight percent. The toners of the present invention, in embodiments, possess toner admix times of from less than about 15 seconds, or an admix time of from about 1 to about 14 seconds, and a triboelectric charge of, for example, from about 10 to about 40 microcoulombs per gram.

The resin can be any suitable binder, such as thermoplastic resins, specific examples being styrene polymers, acrylates, methacrylates, and more specifically styrene-butadienes, styrene acrylates, styrene methacrylates, and polyesters including a reactively extruded polyesters such as illustrated, for example in, U.S. Pat. Nos. 5,376,494 and 5,234,787, the disclosures of which are incorporated by reference herein in their entirety, and mixtures thereof.

The toners of the present invention in embodiments possess and initial or unaged toner cohesion flow values of less than about 25 percent, that is from about 5 to about 25 percent, and after aging, for example when aged in an aggressive xerographic development environment, of below about 65 percent, that is from about 50 to about 65 percent as measured with a Hosokawa Powder Tester available from Micron Powders Systems. The toner cohesion flow values area quantifiable measure of the flow characteristics of a given material, which can be related to the degree to which a toner develops onto a photoreceptor in the xerographic development step. The higher the cohesion value, the lower the flowability of the toner. The maximum, or no flow, cohesion value is 100, the minimum, or freely flowing value, approaches zero. The flow measurement technique involves placing a known mass of toner, for example two grams, on top of a set of three screens, for example with screen meshes of 53 microns, 45 microns, and 38 microns, in order from top to bottom, and vibrating the screens and toner for a fixed time at a fixed vibration amplitude, for example, for 90 seconds at a 1 millimeter vibration amplitude. Thereafter, the mass of toner remaining on each screen is measured and the measured masses are used to compute the cohesion. A cohesion value of 100 corresponds to all of the toner remaining on the top screen at the end of the vibration step and a cohesion value of zero corresponds to all of the toner passing through all three screens, that is, no toner remains on any of the three screens at the end of the vibration step.

Also, the present invention relates to processes for the preparation of toner with for example enhanced flowability and which processes comprise admixing a toner composition generated from a mixture of first toner containing a high molecular weight wax, and second toner containing a low molecular weight wax, and wherein the first and the second toner contain resin, and colorant, and optionally a compatabilizer compound. In embodiments, the mixture of first toner and second toner is combined under low intensity and low energy mixing conditions in Henschel blender device, wherein the first toner is selected in amounts of from about 20 to about 80 weight percent, and the second toner is selected in amounts of from about 20 to about 80 weight percent, and subsequently external additives are blended under high intensity and high energy conditions onto the surface of the toner.

The present invention, in embodiments, encompasses developer compositions comprised of a carrier, preferably coated carrier particles comprising a metal or metal oxide core with a coating thereover comprised of at least one polymer, and a toner composition comprised of toner resin particles, wax and colorant, especially pigment particles.

Toner compositions can be prepared by a number of known methods, such as admixing and heating resin particles such as reactive extruded polyester polymers, colorant particles such as magnetite, carbon black, or mixtures thereof, and cyan, yellow, magenta, green, brown, red, or mixtures thereof, wax, such as polypropylene wax and optionally from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include polyesters, reactive extruded polyesters, linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include reactive extruded polyesters such as those illustrated for example in the aforementioned U.S. Pat. No. 5,376,494. Other preferred toner resins include styrene butadiene copolymers, mixtures thereof, and the like, styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of a charge enhancing additive is present, 5 percent by weight of a wax is present, and 10 percent by weight of pigment or colorant, such as carbon black, is contained therein, about 84 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable colorants, such as pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Colorant includes pigments, dyes, mixtures thereof, mixtures of pigments, mixtures of dyes, and the like.

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions both low and high molecular weight waxes, such as polypropylenes and polyethylenes commercially available from Sanyo Kasei KK, Allied Chemical and Petrolite Corporation, EPOLENE N-15® commercially available from Eastman Chemical Products, Inc., VISCOL 660P®, a low weight average molecular weight polypropylene, and 330P® a high weight average molecular weight polypropylene available from Sanyo Kasei K.K., and similar materials. The commercially available polypropylenes utilized for the toner compositions are believed to have a molecular weight of from about 1,000 to about 4,000 for the low molecular weight polypropylene and from about 10,000 to about 20,000 for the high molecular weight polypropylene. Many of the polyethylene and polypropylene compositions useful in the present invention are illustrated in British Patent No. 1,442,835, the disclosure of which is totally incorporated herein by reference.

The low and high molecular weight wax materials are present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, charge enhancing additives, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60); also carbon black loaded polymethylmethacrylate mixtures can be used. Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments from about 100 to about 230 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition used in conjunction with the coated carriers of the present invention can be prepared by a number of known methods as indicated herein including extrusion melt blending the toner resin particles, wax particles, pigment particles or colorants, and optionally a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 6 to about 12 microns, and most preferably from about 8 to about 11 microns.

Also, the toner compositions, in embodiments, of the present invention possess desirable narrow negative charge distributions, optimal charging triboelectric values, preferably of from about 8 to about 40, and more preferably from about 10 to about 30 microcoulombs per gram as determined by the known Faraday Cage methods; and rapid admix charging times as determined in the charge spectrograph of less than 15 seconds, and more preferably in some embodiments from about 1 to about 14 seconds.

Admix time for toners are preferably from about 5 seconds to 1 minute, and more specifically less than about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

COMPARATIVE EXAMPLE I

Preparation of Low Molecular Weight Wax (660P) Toner: There was prepared in an extrusion device, available as ZSK-40 from Werner Pfleiderer, a toner composition by adding to the extrusion device 86 percent by weight of a crosslinked polyester resin consisting of a bisphenol-A propylene oxide fumarate terpolymer, with about 33 to 40 percent gel content, 5 percent by weight of REGAL 330® carbon black pigment, 5 percent by weight of 660P Sanyo polypropylene wax, and 4 percent by weight of Elf AtoChem AX8840 compatibilizer, a block copolymer of ethylene-diglycidyl methacrylate. The product was then extruded at a rate of 200 pounds per hour, reaching a melt temperature of about 160° C. The melt product exiting from the extruder was cooled to about 25° C. on a belt and then crushed into small particles. The resulting toner was subjected to grinding on an AFG micronizer, model 200AFG, enabling toner particles with a volume median diameter of 9 to 13 microns as measured by a Coulter Counter. Thereafter, the aforementioned toner particles were classified in a Donaldson Model B classifier for the purpose of removing fines particles, that is, those with a volume median diameter of less than about, or equal to about four microns. The final volume median diameter of the toner after classification was 9.48 microns. Using a Hosokawa Powder Tester instrument, a cohesion value of the above classified toner was 82.0.

A final toner composition was prepared from the above classified toner by blending the above classified toner with an external additives package of: 0.6 percent by weight of a hexamethyldisilazane surface-treated silica with an 8 nanometer particle size, TS-530 available from Cabosil Corp., 0.8 percent by weight of a decylsilane surface-treated titania with a 16 nanometer particle size, MT-3103 available from Tayca Corp., 1.0 percent by weight of untreated titania with a 25 nanometer particle size, P-25 available from Degussa Chemicals, and 0.2 percent by weight of the film forming additive zinc stearate from Synpro Inc. The blending was accomplished in an OM-dizer mixer, a low intensity mixer manufactured by Nara Machinery, using a blend speed of 1,000 RPM and a blend time of about 20 minutes. A cohesion value of 13.2 was measured using the Hosokawa Powder Tester to quantify the flow properties of this final toner with external additives.

The triboelectric value of the final prepared toner was measured by the Faraday cage blowoff method and compared against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 12.0 microcoulombs per gram.

The cohesion values of the blended toner were measured as a function of aging time in a Nara Hybridizer Model NHS-0, manufactured by Nara Machine Company, Ltd., using the conditions of maximum tool speed (14,000 RPM), a 25 gram batch size, and no cooling of the jacket. The blend times chosen for aging were 0.31 minutes, which corresponds to an energy equivalent of about 20 minutes of aging in an aggressive xerographic developer environment, and 1.18 minutes, a blend time sufficient to age the toner to a steady-state cohesion value, that is, a value which will not change any further with increased blending time. At these aging times, the cohesion values of the toners were 82.2 and 88.3, respectively. These aged toner cohesion values are equivalent to the cohesion value of the classified toner, that is, the effect of the external additives on toner cohesion has been eliminated under these conditions. A cohesion value of less than about 65 is of importance for functional development in a xerographic environment. Aging in a xerographic environment, such as the Xerox Corporation Model 5090® for 20 minutes in a non throughput mode is equivalent to aging a toner for greater than about 100,000 copies with an average print area coverage of about 2 percent of a page, which is required of a xerographic development system.

The fusing properties of the above prepared classified toner was measured using a prototype Xerox Model DC265 Fuser in which the toner was first charged against a carrier of nominal 100 micron nickel zinc ferrite with a methyl terpolymer coating consisting of methyl methacrylate, styrene and silane to enable the proper developer triboelectric characteristics. The toner was then developed and transferred to paper with a transferred mass of about 1.1 mg per square centimeter. The fuser oil rate was about 0.5 microliters per copy. The minimum fix temperature to enable a toner crease value of 65 was measured to be 169° C., the cold offset temperature was measured to be about 149° C., the hot offset temperature was greater than about 208° C., and the stripper finger mark temperature, that is the minimum fusing temperature which gives acceptable stripper finger marks, was about 172° C. This suggests a fusing temperature, or fusing latitude, of between about 172° C. and about 208° C., or a range of over about 36° C.

COMPARATIVE EXAMPLE II

Preparation of High Molecular Weight Wax (330P) Toner: COMPARATIVE EXAMPLE I was repeated with the exception that the 660P wax was substituted with a 330P wax in the same weight percentage of 5.0 weight percent, and a final classified toner particle size of 9.10 microns was achieved. A Hosokawa Powder Tester was used to quantify the flow properties of this classified toner and yielded a cohesion value of 60, that is, a value significantly below that of the classified toner containing 660P wax (Comparative Example I). Thereafter a final toner composition was prepared using the same external additive set blended onto the classified toner using the same procedure as Comparative Example I. The Hosokawa Powder Tester was used to quantify the flow properties of this final toner with external additives and yielded a cohesion value of 16.4, which is approximately the same value of the blended toner containing 660P wax (Comparative Example I).

The triboelectric value of the final prepared toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was measured to be 11.5 microcoulombs per gram, which is approximately equivalent to the tribo value of the toner prepared in Comparative Example I.

The cohesion values of the blended toner were measured as a function of aging time in a Nara Hybridizer in the same manner as in Comparative Example I. At aging times of 0.31 and 1.18 minutes the cohesion values were 50.8 and 66.8, respectively. Note that the value at 0.31 minutes of aging time is below the cohesion value of about 65 percent which value is an important threshold or limit for functional development in a xerographic environment.

The fusing properties of the above prepared classified toner were measured using the same procedure and equipment as in Comparative Example I. The minimum fix temperature to enable a toner crease value of 65 was measured to be 171° C., the cold offset temperature was 153° C., the hot offset temperature was greater than about 208° C., and the stripper finger mark temperature, that is the minimum fusing temperature which gives acceptable stripper finger marks, less than about 145° C. This suggests a fusing temperature, or fusing latitude, of between about 171° C. and about 208° C., or a range of over about 37° C., equivalent to the fusing latitude of the toner of Comparative Example I which contained 660P wax.

COMPARATIVE EXAMPLE III

Preparation of Internal Mixture of Low Molecular Weight Wax(660P)Toner And High Molecular Weight Wax(330P) Toner: COMPARATIVE EXAMPLE I was repeated with the exception that the 660P wax and the 330P wax were melt mixed together with the resin and colorant in equal amounts, 2.50 weight percent each, such that the total weight percentage of the mixture of waxes was equal to 5.0 weight percent, and a final toner particle size of 9.22 microns was achieved. A cohesion value of 74.0 was measured with the Hosokawa Powder Tester to quantify the flow properties of this classified toner, which value was intermediate between the values of the classified toner containing 660P wax (Comparative Example I) and the classified toner containing 330P wax (Comparative Example II). Thereafter a final toner composition was prepared using the same external additive set blended onto the classified toner using the same procedure as Comparative Example I. A cohesion value of 19.0 was measured with the Hosokawa Powder Tester to quantify the flow properties of this final toner with external additives, which value was about the same value of the blended toner containing 660P wax (Comparative Example I) and also about the same value of the blended toner containing 330P wax (Comparative Example I)

The triboelectric value of the final prepared toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was about 11.5 microcoulombs per gram, that is, roughly equivalent to the tribo value of the toner prepared in Comparative Examples I and II.

The cohesion values of the blended toner were measured as a function of aging time in a Nara Hybridizer in the same manner as in Comparative Example I. At aging times of 0.31 and 1.18 minutes the cohesion values were 65.3 and 80.4, respectively. These values were intermediate between the values of the blended toner containing 660P wax (Comparative Example I) those of the blended toner containing 330P wax (Comparative Example II).

The fusing properties of the above prepared classified toner were measured using the same procedure and equipment as in Comparative Example I. The minimum fix temperature to enable a toner crease value of 65 was about 172° C., the cold offset temperature was about 149° C., the hot offset temperature was greater than about 208° C., and the stripper finger mark temperature, that is, the minimum fusing temperature which gives acceptable stripper finger marks, was less than about 145° C. This implies a fusing temperature, or fusing latitude, of between about 172° C. and about 208° C., or a range of over about 36° C., which was equivalent to the fusing latitude of the toner of Comparative Example I which contained 660P wax.

EXAMPLE I

Physical Blend of Low Molecular Weight Wax(660P) Toner and High Molecular Weight Wax(330P) Toner: COMPARATIVE EXAMPLES I and II were repeated with the exception that the resulting 660P wax containing toner of COMPARATIVE EXAMPLE I and the resulting 330P wax containing toner COMPARATIVE EXAMPLE II were physically blended together in equal amounts such that the total weight percentage of waxes was equal to 5.0 weight percent. A cohesion value of about 68.0 was measured with the Hosokawa Powder Tester to quantify the flow properties of this classified toner, and which value was intermediate between the values of the classified toner containing 660P wax (Comparative Example I) and the classified toner containing 330P wax (Comparative Example II), and below the cohesion value of the toner containing 660P and 330P wax blended internally into the toner particles (Comparative Example III). Thereafter a final toner composition was prepared using the same external additive set blended onto the classified toner using the same procedure as Comparative Example I. A cohesion value of 19.3 was measured with the Hosokawa Powder Tester to quantify the flow properties of this final toner with external additives, which value was approximately the same value of the blended toner containing 660P wax (Comparative Example I), approximately the same value of the blended toner containing 330P wax (Comparative Example II), and approximately the same value of the blended toner containing 660P and 330P wax blended internally into the toner particles (Comparative Example III).

The triboelectric value of the final prepared toner was measured against a carrier of an irregular steel core coated with 1 percent by weight of a carbon black loaded polymethylmethacrylate polymer. After mixing the toner and carrier at a toner concentration of 4 percent by weight for 10 minutes in a standard mixing device, the triboelectric charge imparted to the toner was 11.8 microcoulombs per gram, which was approximately equivalent to the tribo value of the toners prepared in Comparative Examples I, II and III.

The cohesion values of the blended toner were measured as a function of aging time in a Nara Hybridizer in the same manner as in Comparative Example I. At aging times of 0.31 and 1.18 minutes the cohesion values were 63.1 and 71.2, respectively. These values were in between the values of the blended toner containing 660P wax (Comparative Example I), and those of the blended toner containing 330P wax (Comparative Example II), and lower than the values of the blended toner containing both 660P and 330P wax blended internally into the toner particles (Comparative Example III). Note also that the flow value at 0.31 minutes of aging time is below the cohesion value of 65 and is believed to be important for functional development in a xerographic environment.

The fusing properties of the above prepared classified toner were not measured. However, based on the independence of the fusing latitude of the toner on wax type, that is, the equivalent fusing latitudes of Comparative Examples I, II, and III, it is expected that the above prepared classified toner will have the same fusing latitude as Comparative Examples I, II, and III.

Other modifications of the present invention may occur to one of ordinary skill in the art based upon a review of the present application and these modifications, including equivalents thereof, are intended to be included within the scope of the present invention.

What is claimed is:

1. A toner comprising a mixture of first toner with a high weight average molecular weight wax of from about 10.000 to about 20,000, and second toner with a low weight average molecular weight wax of from about 1,000 to about 4,000, wherein the first toner is selected in an amount of from about 10 to about 90 weight percent, and the second toner is selected in an amount of from about 10 to about 90 weight percent.

2. A toner in accordance with claim 1, wherein said first toner and said second toner contain a resin and colorant.

3. A toner in accordance with claim 2, wherein the colorant is a pigment or a dye and mixtures thereof present in amounts of from about 2 to about 10 weight percent based on the total weight of the toner.

4. A toner in accordance with claim 3, wherein the colorant is a selected from the group consisting of a carbon black, a magnetite, a cyan pigment, a magenta pigment, a yellow pigment, a red pigment, a green pigment, a blue pigment, a brown pigment, and mixtures thereof.

5. A toner in accordance with claim 1, further comprising a compatibilizer compound present in an amount of from about 0.5 to about 10 weight percent of the total weight of the toner.

6. A toner in accordance with claim 1, wherein the first toner is selected in an amount of about 50 weight percent, and the second toner is selected in an amount of 50 weight percent.

7. A toner in accordance with claim 1, wherein the total wax content of the resulting toner is from about 2 to about 10 weight percent.

8. A toner in accordance with claim 1, further comprising a charge additive present in an amount of from about 0.05 to about 5 weight percent.

9. A toner in accordance with claim 1 wherein the resin is a styrene-butadiene, styrene acrylate, a styrene methacrylate, or a polyester.

10. A toner composition in accordance with claim 1, wherein the polymer is a polyester.

11. A toner in accordance with claim 1, wherein the weight average molecular weight difference between the high molecular weight wax and the low molecular weight wax is from about 5,000 to about 18,000.

12. A toner in accordance with claim 1, wherein the initial cohesion flow value of the toner composition is from about 5 to about 25 percent, and wherein cohesion flow value after about 0.31 minutes of accelerated aging of the toner composition is from about 50 to about 65 percent.

13. A toner in accordance with claim 1, with a toner admix time of from about 1 to about 15 seconds, and with a triboelectric charge of from about 10 to about 40 microcoulombs per gram.

14. A toner composition in accordance with claim 1, wherein said high and low molecular weight waxes are selected from the group consisting of polyalkylene waxes prepared from unsaturated monomers having from 2 to about 12 carbon atoms, paraffin waxes, carnuba waxes, oxidized polyolefins, polyolefins with acid groups, and mixtures thereof.

15. An imaging process comprising:

contacting the toner of claim 1 with a charged image receiving member, wherein a printed image results.

* * * * *

UNITED STATES PATENT AND TRADEMARK OFFICE

CERTIFICATE OF CORRECTION

PATENT NO. : 5,948,583
DATED : September 7, 1999
INVENTOR(S) : Scott M. Silence

It is certified that error appears in the above-identified patent and that said Letters Patent is hereby corrected as shown below:

Title page,
Insert Item -- [73] Assignee: Xerox Corporation, Stamfort CT --.

Signed and Sealed this

Twenty-fifth Day of October, 2005

JON W. DUDAS
*Director of the United States Patent and Trademark Office*